US010752996B2

(12) United States Patent
Azuma et al.

(10) Patent No.: US 10,752,996 B2
(45) Date of Patent: Aug. 25, 2020

(54) SURFACE TREATMENT AGENT, SURFACE TREATMENT METHOD, AND SURFACE TREATED METAL MATERIAL

(71) Applicant: Nihon Parkerizing Co., Ltd, Tokyo (JP)

(72) Inventors: Takeru Azuma, Tokyo (JP); Atsushi Moriyama, Tokyo (JP); Masayasu Ara, Tokyo (JP)

(73) Assignee: NIHON PARKERIZING CO., LTD, Tokyo (JP)

( * ) Notice: Subject to any disclaimer, the term of this patent is extended or adjusted under 35 U.S.C. 154(b) by 213 days.

(21) Appl. No.: 15/740,306

(22) PCT Filed: Jun. 22, 2016

(86) PCT No.: PCT/JP2016/068537

§ 371 (c)(1),
(2) Date: Dec. 27, 2017

(87) PCT Pub. No.: WO2017/002683

PCT Pub. Date: Jan. 5, 2017

(65) Prior Publication Data

US 2018/0187312 A1 Jul. 5, 2018

(30) Foreign Application Priority Data

Jul. 1, 2015 (JP) ..... 2015-132484

(51) Int. Cl.

| | |
|---|---|
| ***C25D 13/20*** | (2006.01) |
| ***C23C 28/00*** | (2006.01) |
| ***C23C 22/83*** | (2006.01) |
| ***C23C 22/07*** | (2006.01) |
| ***C25D 9/02*** | (2006.01) |

(52) U.S. Cl.

CPC ..... *C23C 22/83* (2013.01); *C23C 22/07* (2013.01); *C23C 28/00* (2013.01); *C23C 28/3215* (2013.01); *C23C 28/34* (2013.01); *C25D 9/02* (2013.01); *C25D 13/20* (2013.01)

(58) Field of Classification Search

CPC ..... C25D 13/20; C23C 28/00

USPC ..... 205/510; 204/510, 486

See application file for complete search history.

(56) References Cited

U.S. PATENT DOCUMENTS

| | | | | |
|---|---|---|---|---|
| 3,914,519 | A | 10/1975 | Hall et al. | |
| 5,653,823 | A * | 8/1997 | McMillen | C23C 22/83 148/247 |
| 5,916,864 | A * | 6/1999 | Fujino | C11D 3/43 510/238 |
| 5,972,522 | A | 10/1999 | Gomi | |
| 2002/0108678 | A1 | 8/2002 | Montano | |
| 2003/0047244 | A1 | 3/2003 | Oyama et al. | |
| 2008/0041498 | A1 | 2/2008 | Inbe et al. | |
| 2013/0230425 | A1 | 9/2013 | Dechant | |
| 2016/0208115 | A1 | 7/2016 | Kato | |

FOREIGN PATENT DOCUMENTS

| | | | |
|---|---|---|---|
| CN | 1814860 | A | 8/2006 |
| JP | 58113379 | | 7/1983 |
| JP | 5214544 | | 8/1993 |
| JP | 2002332447 | A | 11/2002 |
| JP | 2004515645 | | 5/2004 |
| JP | 2005206888 | A | 8/2005 |
| JP | 2006181911 | A | 7/2006 |
| JP | 2010031332 | A | 2/2010 |
| JP | 2011021266 | | 2/2011 |
| TW | 500829 | B | 9/2002 |
| WO | WO2013/089292 | A1 | 6/2013 |
| WO | WO-2015/029836 | A1 | 3/2015 |

* cited by examiner

*Primary Examiner* — Edna Wong
(74) *Attorney, Agent, or Firm* — Muncy, Geissler, Olds & Lowe, P.C.

(57) ABSTRACT

A surface treatment agent which is chromate-free and which can impart excellent coating adhesion and corrosion resistance to a metal material (in particular, a metal material treated with a phosphate), a surface treatment method that uses the surface treatment agent, and a surface treated metal material that is treated using the method are provided. The agent is for a metal material and contains a water-soluble ethylene glycol monoalkyl ether. It is preferable for this surface treatment agent to contain at least one type of metal compound selected from among a water-soluble vanadium compound, a water-soluble titanium compound, a water-soluble zirconium compound and a water-soluble hafnium compound.

6 Claims, No Drawings

SURFACE TREATMENT AGENT, SURFACE TREATMENT METHOD, AND SURFACE TREATED METAL MATERIAL

TECHNICAL FIELD

The present invention relates to a surface treatment agent for various metal materials including ferrous materials such as steel sheets (e.g., cold-rolled steel sheets, hot-rolled steel sheets, galvanized steel sheets, alloy coated steel sheets), aluminum-based materials such as aluminum sheets, and zinc-based materials, as well as a surface treatment method using the surface treatment agent, and a surface-treated metal material having been subjected to surface treatment through the surface treatment method.

BACKGROUND ART

Phosphate treatment is generally used as surface preparation treatment for painting of metal materials. Known examples of such phosphate treatment include zinc phosphate treatment and iron phosphate treatment. After this phosphate treatment, treatment using a chromate solution (chromate treatment) is performed in some cases for the purpose of enhancing corrosion resistance and paint adhesion. However, the chromate solution contains chromium and is therefore environmentally disadvantageous.

From this viewpoint, alternative techniques related to surface treatment agents that could replace the chromate solution have been studied. For example, Patent Literature 1 discloses a composition that contains a fluorine-containing compound, a water soluble and/or water dispersible resin compound having cationic or nonionic properties, phosphoric acid and/or a phosphate compound, and water, and that has an adjusted pH of 1 to 6 (see claim 1).

CITATION LIST

Patent Literature

Patent Literature 1: JP 2005-206888 A

SUMMARY OF INVENTION

Technical Problems

An object of the present invention is to provide a surface treatment agent capable of imparting excellent paint adhesion and corrosion resistance to a metal material (particularly, a metal material having been subjected to phosphate treatment) without use of chromate, as well as a surface treatment method using the surface treatment agent, and a surface-treated metal material having been subjected to surface treatment through the surface treatment method.

Solution to Problems

The present inventors have made an intensive study on the foregoing object and as a result found that when a metal material, particularly a metal material having been subjected to chemical conversion treatment such as phosphate treatment is brought into contact with a surface treatment agent obtained by adding a water-soluble ethylene glycol monoalkyl ether to water and then a paint film is formed, a composite layer having excellent paint adhesion and corrosion resistance can be formed on/over the metal material. The inventors have thus completed the invention.

Accordingly, the inventors of the present invention found that the object can be achieved by the characteristic features as described below.

(1) A surface treatment agent for a metal material, comprising: a water-soluble ethylene glycol monoalkyl ether.

(2) The surface treatment agent according to (1) above, further comprising at least one metal compound selected from a water-soluble vanadium compound, a water-soluble titanium compound, a water-soluble zirconium compound, and a water-soluble hafnium compound.

(3) The surface treatment agent according to (2) above, further comprising a fluorine ion trapping agent.

(4) The surface treatment agent according to (2) or (3) above, wherein pH is in a range of 3 to 5.

(5) The surface treatment agent according to (1) above, wherein the surface treatment agent consists of water and one or more water-soluble ethylene glycol monoalkyl ethers.

(6) The surface treatment agent according to (4) above, wherein the surface treatment agent consists of: water; one or more water-soluble ethylene glycol monoalkyl ethers; at least one metal compound selected from a water-soluble vanadium compound, a water-soluble titanium compound, a water-soluble zirconium compound, and a water-soluble hafnium compound; and a pH adjuster optionally added, wherein pH is in a range of 3 to 5.

(7) The surface treatment agent according to (4) above, wherein the surface treatment agent consists of: water; one or more water-soluble ethylene glycol monoalkyl ethers; at least one metal compound selected from a water-soluble vanadium compound, a water-soluble titanium compound, a water-soluble zirconium compound, and a water-soluble hafnium compound; a fluorine ion trapping agent; and a pH adjuster optionally added, wherein pH is in a range of 3 to 5.

(8) A surface treatment method for a metal material, comprising: a step X of bringing a chemical conversion coating formed on/over a surface of the metal material and/or the surface of the metal material into contact with the surface treatment agent according to any one of (1) to (7) above.

(9) The surface treatment method according to (8) above, wherein the chemical conversion coating is formed by bringing a phosphate-containing chemical conversion agent into contact with the surface of the metal material.

(10) The surface treatment method according to (8) or (9) above, further comprising, after the step X, a step Y of performing electrodeposition coating on/over the surface of the metal material.

(11) A surface-treated metal material having been subjected to surface treatment through the surface treatment method according to any one of (8) to (10) above.

Advantageous Effects of Invention

As described below, the present invention can provide a surface treatment agent capable of imparting excellent paint adhesion and corrosion resistance to a metal material (particularly, a metal material having been subjected to phosphate treatment), as well as a surface treatment method using the surface treatment agent, and a surface-treated metal material having been subjected to surface treatment through the surface treatment method. The surface treatment agent of the invention is totally free of chromium and is therefore extremely effective at addressing social issues such as environmental protection and recycling.

DESCRIPTION OF EMBODIMENTS

A surface treatment agent, a surface treatment method using the surface treatment agent, and a surface-treated metal material having been subjected to surface treatment through the surface treatment method according to the invention are described below in detail. In the present invention, any numerical range specified using "to" refers to a range including values given before and after "to" as the lower and upper limits of the range.

[Surface Treatment Agent]

The surface treatment agent of the invention is a surface treatment agent for metal materials and contains a water-soluble ethylene glycol monoalkyl ether. According to the surface treatment agent of the invention, the use of the surface treatment agent containing a water-soluble ethylene glycol monoalkyl ether makes it possible to impart excellent paint adhesion and corrosion resistance to a metal material (particularly, a metal material having been subjected to chemical conversion treatment using a phosphate-containing treatment agent).

The reasons why this occurs are currently not clear and are assumed as described below. In the following, the assumption is described taking as an example a metal material having been subjected to chemical conversion treatment using a phosphate-containing chemical conversion agent (hereinafter called "phosphate treatment"). Probably, in a step of bringing the surface treatment agent of the invention into contact with a metal material having been subjected to phosphate treatment, a surface treatment coating (water-soluble ethylene glycol monoalkyl ether-containing coating) having excellent corrosion resistance and paint adhesion is formed on/over a material surface at portions where a coating (phosphate coating) formed through phosphate treatment is absent (e.g., at gaps between phosphate crystals and at portions where no phosphate crystal is present). Therefore, the surface treatment agent of the invention is effective not only for a metal material whose surface has been subjected to chemical conversion treatment using a phosphate-containing chemical conversion agent but also for a metal material whose surface has been subjected to chemical conversion treatment using another chemical conversion agent.

<Water-Soluble Ethylene Glycol Monoalkyl Ether>

The surface treatment agent of the invention contains a water-soluble ethylene glycol monoalkyl ether. An alkyl group in the ethylene glycol monoalkyl ether may be a linear or branched group. The alkyl group is preferably a $C_1$-$C_8$ alkyl group, more preferably a $C_1$-$C_6$ alkyl group, and particularly preferably a $C_1$-$C_4$ alkyl group. Specific examples of water-soluble ethylene glycol monoalkyl ethers include, but not limited to, ethylene glycol monomethyl ether, ethylene glycol monoethyl ether, ethylene glycol mono-n-butyl ether, ethylene glycol mono-n-hexyl ether, ethylene glycol monoisopropyl ether and ethylene glycol mono-tert-butyl ether. Preferred examples of water-soluble ethylene glycol monoalkyl ethers include ethylene glycol monomethyl ether, ethylene glycol monoethyl ether, ethylene glycol mono-n-butyl ether, ethylene glycol monoisopropyl ether, and ethylene glycol mono-tert-butyl ether. Water-soluble ethylene glycol monoalkyl ethers may be used alone or in combination of two or more. "Soluble in water (water-soluble)" refers to the state where, when an ethylene glycol monoalkyl ether and pure water of the same volume are mixed and slowly stirred at 1 atm at a temperature of 20° C., the mixture maintains its uniform appearance even after the flow stops.

<Metal Compound>

The surface treatment agent of the invention may contain at least one metal compound selected from a water-soluble vanadium compound, a water-soluble titanium compound, a water-soluble zirconium compound, and a water-soluble hafnium compound. In the present description, the metal compound(s) above is called "specific metal compound(s)." The specific metal compounds may be used alone or in combination of two or more.

The specific metal compound is soluble in water, and the counter ion and the chemical composition are not particularly limited as long as the compound contains any of the foregoing metal elements. Examples of such specific metal compounds include carbonates, oxides, hydroxides, nitrates, sulfates, phosphates, fluorine compounds, hydrochlorides, organic acid salts and complex compounds of the foregoing metal elements. Specific examples of the specific metal compounds include: vanadium compounds such as vanadium pentoxide, metavanadic acid, ammonium metavanadate, sodium metavanadate, vanadium oxytrichloride, vanadium trioxide, vanadium dioxide, vanadium oxysulfate, vanadium oxyacetylacetonate, vanadium acetylacetonate, vanadium trichloride, and phospho-vanado-molybdic acid; titanium compounds such as titanium sulfate, titanium nitrate, titanium oxide, titanium fluoride, hexafluorotitanic acid, ammonium hexafluorotitanate, potassium hexafluorotitanate, and sodium hexafluorotitanate; zirconium compounds such as zirconium nitrate, zirconium sulfate, zirconium oxide, zirconium fluoride, zirconium chloride, hexafluorozirconic acid, ammonium hexafluorozirconate, potassium zirconium hydracid, sodium zirconium hydracid, sodium hexafluorozirconate, potassium hexafluorozirconate, and zirconium stearate; and hafnium compounds such as hafnium sulfate, hafnium nitrate, hafnium chloride, hexafluorohafnic acid, hafnium oxide, and hafnium fluoride. The water-soluble compound herein refers to a compound having a solubility of 0.1 g or more (preferably 0.5 g or more) per 1000 ml of water (20° C.)

<Fluorine Ion Trapping Agent>

The surface treatment agent of the invention may contain a fluorine ion trapping agent. The fluorine ion trapping agent is used for trapping excess fluorine ions (fluoride ions) derived from a component (e.g., the specific metal compound described above) contained in the surface treatment agent. When the concentration of the fluorine ions (free fluorine ions) is too high, etching to a metal material becomes excessive, and the effect of enhancing corrosion resistance and paint adhesion may not be obtained. Therefore, when a specific metal compound-containing surface treatment agent used in surface treatment has a high fluorine ion concentration, the fluorine ion trapping agent may be added to the surface treatment agent in advance. When, however, the surface treatment agent has a low fluorine ion concentration, it is not necessary to add the fluorine ion trapping agent to the surface treatment agent. The fluorine ion trapping agent may be suitably added depending on the fluorine ion concentration of the surface treatment agent used in surface treatment.

Examples of the fluorine ion trapping agent include metals such as zinc, aluminum, magnesium, titanium, iron, nickel, copper and calcium, and hydroxides, chlorides, fluorides and oxides of those metals; as well as silicon and boron, and silicon compounds and boron compounds such as oxoacids and oxides of silicon and boron. More specific examples include aluminum oxide, aluminum hydroxide, aluminum fluoride, aluminum chloride, aluminum sulfate, aluminum nitrate, aluminum oxide-boron oxide-hydrate ($2Al_2O_3.B_2O_3.3H_2O$), orthoboric acid, metaboric acid, aluminum chloride, silicon, calcium oxide, boron oxide, silicon dioxide, and magnesium oxide. The fluorine ion trapping agents may be used alone or in combination of two or more.

<Water>

The surface treatment agent of the invention contains water. Water is a solvent for dissolving and/or dispersing the foregoing components. For the water, use may be made of waters obtained by removing ionic impurities as much as possible, such as pure and ultrapure waters including ion-exchanged water, ultrafiltered water, reverse osmosis water, and distilled water.

<Other Components>

When the surface treatment agent of the invention contains the specific metal compound, the pH falls within the range of 3 to 5. When the pH needs adjustment, a pH adjuster may be added. The pH adjuster is not particularly limited and may be an acidic or alkaline component. Examples of the acidic component include inorganic acids such as phosphoric acid, hydrochloric acid, sulfuric acid, nitric acid, formic acid, acetic acid and hydrofluoric acid; and organic acids such as acetic acid, tannic acid and oxalic acid. Examples of the alkaline component include sodium hydroxide, potassium hydroxide, ammonia, and primary to tertiary amines.

<Preparation Method>

The preparation method of the surface treatment agent of the invention is not particularly limited, and known methods can be employed. An exemplary method involves adding an ethylene glycol monoalkyl ether and optionally predetermined arbitrary components (e.g., the specific metal compound, the fluorine ion trapping agent and the pH adjuster) to water, thereby preparing the surface treatment agent.

The water-soluble ethylene glycol monoalkyl ether content of the surface treatment agent of the invention is preferably 0.02 to 6.00 mmol/L, more preferably 0.02 to 4.00 mmol/L, and particularly preferably 0.02 to 1.50 mmol/L. When the content falls within the foregoing ranges, the composite layer formed on/over a surface of a metal material can have further enhanced paint adhesion and corrosion resistance.

When the surface treatment agent contains the specific metal compound, the specific metal compound content of the surface treatment agent is preferably 0.01 to 4.00 mmol/L, more preferably 0.01 to 2.50 mmol/L, and particularly preferably 0.01 to 2.00 mmol/L. When the content falls within the foregoing ranges, the composite layer formed on/over the surface of the metal material can have further enhanced paint adhesion and corrosion resistance.

When the fluorine ion trapping agent is added in advance to the surface treatment agent used in surface treatment, the fluorine ion trapping agent content of the surface treatment agent is preferably 0.01 to 8.0 mmol/L, more preferably 0.01 to 5.0 mmol/L, and particularly preferably 0.01 to 4.0 mmol/L.

<Physical Properties>

When the surface treatment agent of the invention contains the specific metal compound, the pH should fall within the range of 3 to 5, and the pH is preferably in the range of 3.5 to 4.5. When the pH of the surface treatment agent falls within the foregoing ranges, the composite layer formed on/over the surface of the metal material can have further enhanced corrosion resistance and paint adhesion. Those effects are exhibited better when a phosphate coating is formed on/over the surface of the metal material. To be more specific, when a phosphate coating is formed on/over the surface of the metal material, crystals called built-up crystals or secondary crystals are sometimes formed, and such crystals may lead to lower corrosion resistance and paint adhesion. In this case, when the pH of the surface treatment agent is in the range of 3 to 5, such crystals can be dissolved and removed more effectively, resulting in more excellent corrosion resistance and paint adhesion.

The method of pH adjustment above is not particularly limited, but the use of the pH adjuster described above is preferred because it makes the adjustment easier. One pH measurement method is a method of measuring the pH at room temperature (20° C.) with an existing pH meter.

<Application>

The surface treatment agent of the invention is used in surface treatment of a metal material. Examples of metal materials to be treated include metal sheets such as steel sheets (electrogalvanized steel sheets, hot-dip galvanized steel sheets, alloyed hot-dip galvanized steel sheets, cold-rolled steel sheets, hot-rolled steel sheets) and aluminum sheets. In particular, the surface treatment agent of the invention is favorably used for a metal material having been subjected to phosphate treatment using zinc phosphate, iron phosphate or the like (phosphate-treated material). Alternatively, the surface treatment agent may be applied to metal materials having been subjected to the foregoing chemical conversion treatment other than the phosphate treatment. The phosphate-treated material has a phosphate coating formed through the phosphate treatment on/over a surface of a metal material.

A metal material having been subjected to, of phosphate treatments, zinc phosphate treatment (zinc phosphate-treated material) has a zinc phosphate coating formed on/over its surface. The dry mass of the zinc phosphate coating is preferably 0.8 to 5.0 g/m$^2$, more preferably 1.2 to 4.5 g/m$^2$, and even more preferably 1.5 to 4.0 g/m$^2$. When the dry mass of the zinc phosphate coating is 0.8 g/m$^2$ or more, the surface of the metal material is less exposed, leading to excellent corrosion resistance, and thus a corrosion resistance effect of the phosphate coating is exhibited better. When the dry mass is 5.0 g/m$^2$ or less, crystals of a phosphate-based coating can be prevented from getting coarse, and accordingly, paint adhesion is further excellent in cases where post-painting treatment is carried out. The zinc phosphate coating is primarily composed of zinc phosphate-based crystals and may contain one or more metal elements such as, for instance, Zn, Ni, Mn, Mg, Co and Ca. When the metal element or elements are contained, corrosion resistance and adhesion of the zinc phosphate coating are further enhanced. In particular, Ni, Mn and Mg are further effective at improving corrosion resistance.

A metal material having been subjected to, of phosphate treatments, iron phosphate treatment (iron phosphate-treated material) has an iron phosphate coating formed on/over its surface. The iron phosphate coating is composed of iron phosphate and iron oxide and has a dry mass of preferably 0.1 to 2.0 g/m$^2$ and more preferably 0.5 to 2.0 g/m$^2$.

[Surface Treatment Method, Surface-Treated Metal Material]

The surface treatment method using the surface treatment agent of the invention is not particularly limited but preferably includes a step of bringing a surface of a metal material and/or a chemical conversion coating formed on/over the surface into contact with the surface treatment agent. Owing to this step, a surface-treated metal material can be obtained. In particular, one of preferred embodiments of the surface treatment method is a surface treatment method including a step X of bringing the chemical conversion coating formed on/over the surface of the metal material into contact with the surface treatment agent.

The method of bringing the chemical conversion coating into contact with the surface treatment agent is not particularly limited, and exemplary methods include an immersing method, a spraying method, a flowing method, and an electrolysis method. The treatment temperature during this process is preferably 10° C. to 55° C. The treatment time is preferably 5 to 300 seconds.

The chemical conversion coating can be formed by bringing a phosphate-containing chemical conversion agent into contact with the surface of the metal material (this step is hereinafter called "chemical conversion coating formation step"). In this case, the chemical conversion coating can be called the phosphate coating that is formed through the phosphate treatment described above. The chemical conversion agent may further contain known components contained in conventional chemical conversion agents, such as various solvents, and such components are not particularly limited. The method of forming the chemical conversion coating is not particularly limited, and a conventionally known method may be employed.

The step X is preferably conducted for the chemical conversion coating and sometimes called post-treatment of chemical conversion treatment (particularly, phosphate treatment). Accordingly, the surface treatment agent of the invention used in this step is sometimes called a post-treatment agent. In particular, as described above, the surface treatment agent is favorably used as a post-treatment agent for the phosphate coating (a post-treatment agent for the phosphate-treated material).

<Other Steps>

The step X may be followed by a painting step. A step of drying the surface of the metal material that has been brought into contact with the surface treatment agent of the invention and has the chemical conversion coating (hereinafter called "drying step") may be conducted between the step X and the painting step, or the drying step may not be necessarily conducted. The step X may be followed by a water rinsing step.

Painting in the painting step can be performed by, for instance, spray coating, electrostatic coating, electrodeposition coating, roll coating, brush coating or another method. The painting step after the step X is, for example, a step Y of performing electrodeposition coating on/over the surface of the metal material.

In the surface treatment method of the invention, the chemical conversion coating formation step may be preceded by a pretreatment step. Examples of the pretreatment step include an acid degreasing treatment step, an alkali degreasing treatment step, a surface conditioning treatment step, a pickling step, an alkali cleaning step, a water rinsing step, and a drying step. Two or more of the pretreatment steps may be used in combination. The acid degreasing treatment step, alkali degreasing treatment step, surface conditioning treatment step, pickling step, alkali cleaning step and the like may be conducted using existing treatment agents.

The surface-treated metal material having been subjected to surface treatment through the surface treatment method of the invention as described above can exhibit excellent corrosion resistance and paint adhesion when having a paint film formed on/over its surface. As is clear from the surface treatment method above, the surface-treated metal material of the invention has at least a phosphate coating and, thereon, a coating (surface treatment coating) formed using the surface treatment agent of the invention. The surface-treated metal material of the invention may further have a paint film on/over the surface treatment coating.

EXAMPLES

The surface treatment agent of the invention is described below more specifically by way of examples. However, the present invention is not limited thereto.

1. Production of Test Sheet (1) Test Material (Metal Material)

The following commercially available metal materials were used for the test materials. The size of the test materials is 70 mm×150 mm.

(i) Cold-rolled steel sheet (SPC material): sheet thickness, 0.8 mm (ii) Alloyed hot-dip galvanized steel sheet (GA material): sheet thickness, 0.8 mm; zinc coating weight, 40 g/m$^2$ (either side)

(iii) Hot-dip galvanized steel sheet (GI material): sheet thickness, 0.8 mm; zinc coating weight, 70 g/m$^2$ (either side)

(iv) Aluminum sheet (aluminum material, 6000 series): sheet thickness, 0.4 mm (2) Production of Phosphate-Treated Material The respective test materials were subjected to phosphate treatment described below to thereby produce phosphate-treated materials.

(I) Zinc Phosphate Treatment for SPC Material

The SPC material was immersed in an alkaline degreasing solution (obtained by diluting FC-E2085 manufactured by Nihon Parkerizing Co., Ltd. at 20g/L, followed by heating to 45° C.) for 2 minutes to clean the surface, and then rinsed with water.

Thereafter, the material was immersed in a surface conditioning solution at room temperature for 20 seconds and subsequently in a zinc phosphate treatment solution (42° C.) for 1 minute, and then rinsed with water, thereby producing a zinc phosphate-treated material having a zinc phosphate coating with a dry mass of 1.4 g/m$^2$. The surface conditioning solution above was prepared by adding, to tap water, PL-X (manufactured by Nihon Parkerizing Co., Ltd.) to a concentration of 3 g/L and AD-4977 (an additive manufactured by Nihon Parkerizing Co., Ltd.) to a concentration of 1 g/L. The zinc phosphate treatment solution above was prepared by adding, to tap water, PB-L3020 (a chemical conversion agent for surface preparation for painting, manufactured by Nihon Parkerizing Co., Ltd.) to a concentration of 48 g/L, AD-4813 (an additive manufactured by Nihon Parkerizing Co., Ltd.) to a concentration of 5 g/L, and AD-4856 (an additive manufactured by Nihon Parkerizing Co., Ltd.) to a concentration of 17 g/L, neutralizing the mixture with NT-4055 (a neutralizer manufactured by Nihon Parkerizing Co., Ltd.) to a free acidity of 1.0 point, and then further adding AC-131 (an accelerator manufactured by Nihon Parkerizing Co., Ltd.) to a concentration of 0.42 g/L. The free acidity herein refers to a mL value, represented by a point value (1 mL=1 point), at the time when the zinc phosphate treatment solution in an amount of 10 mL was taken, 2 or 3 drops of bromophenol blue indicator were added thereto, and the mixture was titrated with 0.1 N aqueous sodium hydroxide solution.

(II) Zinc Phosphate Treatment for GA Material

Zinc phosphate treatment was performed under the same conditions as those for (I) except that the GA material was used in place of the SPC material, thereby producing a zinc phosphate-treated material having a zinc phosphate coating with a dry mass of 2.8 g/m$^2$.

(III) Zinc Phosphate Treatment for GI Material

Zinc phosphate treatment was performed under the same conditions as those for (I) except that the GI material was used in place of the SPC material, thereby producing a zinc phosphate-treated material having a zinc phosphate coating with a dry mass of 2.5 g/m$^2$.

(IV) Zinc Phosphate Treatment for Aluminum Material

Zinc phosphate treatment was performed under the same conditions as those for (I) except that the aluminum material was used in place of the SPC material, thereby producing a zinc phosphate-treated material having a zinc phosphate coating with a dry mass of 2.5 g/m$^2$.

(3) Production of Surface-Treated Material

After the components were blended in pure water to have a molarity as shown in Table 1, the pH was suitably adjusted with a NaOH aqueous solution (pH adjuster), thereby preparing a surface treatment agent used to produce each of test sheets in Examples 1 to 13 and Comparative examples 1 to 4. In Example 1, pH adjustment was not carried out. Each phosphate-treated material having been rinsed with water after phosphate treatment using a zinc phosphate treatment solution was, without drying, immersed in the corresponding surface treatment agent at room temperature for 30 seconds and then rinsed with water, thereby producing each surface-treated material. Besides, the same process was carried out using pure water as a surface treatment agent, thereby producing a surface-treated material used in test sheet production in Comparative example 5.

The details of the components contained in the surface treatment agents listed in Table 1 are as follows.

(Ethylene Glycol Monoalkyl Ether)

Ethylene glycol mono-n-butyl ether (butyl cellosolve, manufactured by Tokyo Chemical Industry Co., Ltd.)

Ethylene glycol monoethyl ether (cellosolve, manufactured by Tokyo Chemical Industry Co., Ltd.)

Ethylene glycol mono-n-hexyl ether (manufactured by Nippon Nyukazai Co., Ltd.)

(Specific Metal Compound)

Hexafluorotitanic acid (manufactured by Morita Chemical Industries Co., Ltd.)

Hexafluorozirconic acid (manufactured by Morita Chemical Industries Co., Ltd.)

(4) Electrodeposition Coating

Following surface treatment using a specified surface treatment agent or pure water, a surface-treated material having been rinsed with water was, without drying, subjected to electrodeposition coating. The electrodeposition coating was carried out as follows: Cathodic electrolysis was conducted at a constant voltage for 180 seconds using an electrodeposition paint [GT-10HT manufactured by Kansai Paint Co., Ltd.] with the use of a stainless steel plate (SUS 304) as an anode, to deposit a paint film on/over the entire surface of each surface-treated material, followed by rinsing with water and then baking at 170° C. for 20 minutes. The thickness of the paint film formed through the electrodeposition coating was adjusted to 20 μm by controlling the voltage. Thus, the test sheets provided for the post-painting corrosion resistance test and paint adhesion test described below were produced.

2. Post-Painting Corrosion Resistance Test

Each of the test sheets in Examples 1 to 13 and Comparative examples 1 to 5 was cross-cut and subjected to the salt spray test (JIS Z 2371) for 1000 hours. The single side blistering width at the cross cut was measured, and the corrosion resistance was evaluated according to the following evaluation criteria. The results are shown in Table 1.

<Evaluation Criteria>

Excellent: Less than 2 mm

Good: Not less than 2 mm but less than 4 mm

Poor: Not less than 4 mm but less than 6 mm

Very poor: Not less than 6 mm

3. Paint Adhesion Test (1) Primary Paint Adhesion Test

Each of the test sheets in Examples 1 to 13 and Comparative examples 1 to 5 was provided with 100 pieces of 1 mm grid squares, and the central part of each square was pushed by an Erichsen tester to be protruded by 4 mm. Thereafter, a tape peeling test using cellophane adhesive tape [Cellotape (registered trademark) No. 405-1P, manufactured by Nichiban Co., Ltd.] was conducted on the protruded part, and the peeling area ratio was measured. With the measurement results, the primary paint adhesion was evaluated according to the following evaluation criteria. The results are shown in Table 1.

<Evaluation Criteria>

Good: Less than 10%

Poor: Not less than 10% but less than 30%

Very poor: Not less than 30%

(2) Secondary Paint Adhesion Test

The secondary paint adhesion was evaluated in the same manner as that in the primary paint adhesion test except that each test sheet was immersed in boiling water for 1 hour before provision of the grid squares. The results are shown in Table 1.

TABLE 1

| | | Component contained in surface treatment agent (mmol/l) | | | | | | Evaluation result | | |
|---|---|---|---|---|---|---|---|---|---|---|
| | | Specific metal compound | | Ethylene glycol monoalkyl ether | | | | | Paint adhesion | |
| Table 1 | Type of test material | Hexafluorotitanic acid | Hexafluorozirconic acid | Ethylene glycol mono-n-butyl ether (butyl cellosolve) | Ethylene glycol monoethyl ether (cellosolve) | Ethylene glycol mono-n-hexyl ether | pH of surface treatment agent | Corrosion resistance | Primary | Secondary |
| Example 1 | SPC material | — | — | 0.4 | — | — | 6.5 | Good | Good | Good |
| Example 2 | SPC material | 1.5 | — | 0.4 | — | — | 3.0 | Excellent | Good | Good |

TABLE 1-continued

| | | Component contained in surface treatment agent (mmol/l) | | | | | | | | |
|---|---|---|---|---|---|---|---|---|---|---|
| | | | | Ethylene glycol monoalkyl ether | | | | | | |
| | | Specific metal compound | | | | | | Evaluation result | | |
| | | | | | | | | | Paint adhesion | |
| Table 1 | Type of test material | Hexafluoro-titanic acid | Hexafluoro-zirconic acid | Ethylene glycol mono-n-butyl ether (butyl cellosolve) | Ethylene glycol monoethyl ether (cellosolve) | Ethylene glycol mono-n-hexyl ether | pH of surface treatment agent | Corrosion resistance | Pri-mary | Sec-ondary |
| Example 3 | SPC material | 1.5 | — | 0.4 | — | — | 4.2 | Excellent | Good | Good |
| Example 4 | SPC material | 1.5 | — | — | 0.5 | — | 4.2 | Excellent | Good | Good |
| Example 5 | SPC material | 1.5 | — | — | — | 0.4 | 4.2 | Excellent | Good | Good |
| Example 6 | SPC material | 1.5 | — | 0.4 | — | — | 5.0 | Excellent | Good | Good |
| Example 7 | SPC material | 1.5 | — | 3 | — | — | 4.2 | Excellent | Good | Good |
| Example 8 | SPC material | 1.5 | — | 6 | — | — | 4.2 | Excellent | Good | Good |
| Example 9 | GA material | 1.5 | — | 0.4 | — | — | 4.2 | Excellent | Good | Good |
| Example 10 | GI material | 1.5 | — | 0.4 | — | — | 4.2 | Good | Good | Good |
| Example 11 | Aluminum material | 1.5 | — | 0.4 | — | — | 4.2 | Excellent | Good | Good |
| Example 12 | SPC material | — | 1.5 | 0.4 | — | — | 4.2 | Excellent | Good | Good |
| Example 13 | SPC material | 0.3 | 1.2 | 0.4 | — | — | 4.2 | Excellent | Good | Good |
| Comparative example 1 | SPC material | 1.5 | — | — | — | — | 4.2 | Good | Good | Poor |
| Comparative example 2 | GA material | 1.5 | — | — | — | — | 4.2 | Excellent | Good | Poor |
| Comparative example 3 | GI material | 1.5 | — | — | — | — | 4.2 | Good | Good | Poor |
| Comparative example 4 | Aluminum material | 1.5 | — | — | — | — | 4.2 | Excellent | Good | Poor |
| Comparative example 5 | SPC material | — | — | — | — | — | 6.5 | Good | Good | Very poor |

As is evident from the evaluation results in Table 1, it was revealed that when surface treatment was performed using the surface treatment agent of the invention, excellent properties were obtained.

The invention claimed is:

1. A surface treatment method for a metal material, comprising:

a step X of bringing a chemical conversion coating formed on/over a surface of the metal material into contact with a surface treatment agent, and after the step X, a step Y of performing electrodeposition coating on/over the surface of the metal material, wherein the surface treatment agent consists of water and one or more water-soluble ethylene glycol monoalkyl ethers.

2. The surface treatment method according to claim 1, wherein the chemical conversion coating is formed by bringing a phosphate-containing chemical conversion agent into contact with the surface of the metal material.

3. A surface treatment method for a metal material, comprising:

a step X of bringing a chemical conversion coating formed on/over a surface of the metal material into contact with a surface treatment agent, and after the step X, a step Y of performing electrodeposition coating on/over the surface of the metal material, wherein the surface treatment agent consists of: water; one or more water-soluble ethylene glycol monoalkyl ethers; at least one metal compound selected from a water-soluble vanadium compound, a water-soluble titanium compound, a water-soluble zirconium compound, and a water-soluble hafnium compound; and a pH adjuster optionally added, wherein pH is in a range of 3 to 5.

4. The surface treatment method according to claim 3, wherein the chemical conversion coating is formed by bringing a phosphate-containing chemical conversion agent into contact with the surface of the metal material.

5. A surface treatment method for a metal material, comprising:

a step X of bringing a chemical conversion coating formed on/over a surface of the metal material into contact with a surface treatment agent, and after the step X, a step Y of performing electrodeposition coating on/over the surface of the metal material, wherein the surface treatment agent consists of: water; one or more water-soluble ethylene glycol monoalkyl ethers; at least one metal compound selected from a water-soluble vanadium compound, a water-soluble titanium compound, a water-soluble zirconium compound, and a water-soluble hafnium compound; a fluorine ion trapping agent; and a pH adjuster optionally added, wherein pH is in a range of 3 to 5.

6. The surface treatment method according to claim 5, wherein the chemical conversion coating is formed by bringing a phosphate-containing chemical conversion agent into contact with the surface of the metal material.

* * * * *